US008172392B2

(12) United States Patent
Nobuta et al.

(10) Patent No.: US 8,172,392 B2
(45) Date of Patent: May 8, 2012

(54) OPEN/CLOSE JUDGMENT OF OPENING OF DEVICE

(75) Inventors: Kosaku Nobuta, Suwa (JP); Osamu Hanamura, Shiojiri (JP); Yoshiaki Shibasaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 434 days.

(21) Appl. No.: 12/548,351

(22) Filed: Aug. 26, 2009

(65) Prior Publication Data

US 2010/0053675 A1 Mar. 4, 2010

(30) Foreign Application Priority Data

Aug. 27, 2008 (JP) ..... 2008-218201

(51) Int. Cl.
*B41J 29/13* (2006.01)

(52) U.S. Cl. ..... 347/108; 347/19

(58) Field of Classification Search ..... 347/108, 347/19

See application file for complete search history.

(56) References Cited

U.S. PATENT DOCUMENTS 7,029,006 B2 * 4/2006 Izumi et al. ..... 271/145

FOREIGN PATENT DOCUMENTS

JP 2006-264160 A 10/2006

* cited by examiner

*Primary Examiner* — Julian Huffman

(74) *Attorney, Agent, or Firm* — Kilpatrick Townsend & Stockton LLP

(57) ABSTRACT

A printer is disclosed which determines whether or not an opening of the printer is open or closed. The printer includes an opening/closing mechanism for opening and closing the opening of the printer housing. The printer includes a controller configured to determine whether the opening is open or closed based on a light receiving state of a light receiving portion. The light receiving portion receives light from a light sending portion. A first movable body with a plurality of openings is moveable between the light sending and receiving portions. A movement transmission mechanism moves the first moveable body according to movement of a second moveable body.

19 Claims, 9 Drawing Sheets

OPEN/CLOSE JUDGMENT OF OPENING OF DEVICE

This application claims priority to Japanese Patent Application No. 2008-218201, filed Aug. 27, 2008, the entirety of which is incorporated by reference herein.

BACKGROUND

1. Technical Field

The present invention relates to a technique for performing an open/close judgment of an opening of a device.

2. Related Art

An ink jet printer includes an opening for performing, for example, attachment and detachment of an ink cartridge, and a cover for opening and closing the opening. The ink jet printer generally has a judgment device for performing a judgment of whether or not the opening is closed (open/close judgment of the opening) in order to, for example, avoid execution of print operation while the opening is opened. The judgment device for performing the open/close judgment of the opening may be, for example, an open/close sensor having a sensor lever that is interfered with a cover to be displaced when the opening is closed by the cover, and a detection unit for detecting the displacement of the sensor lever is used (for example, see JP-A-2006-264160).

When a conventional open/close sensor is used as the judgment device for performing the open/close judgment of the opening, even when the opening is slightly opened due to a variation or the like of a contact point of the open/close sensor, it is possible that the opened state can not be detected for judging that the opening is closed. Further, there is a risk that the open/close state of the opening is misjudged, since the open/close sensor judges that the opening is closed even when the sensor lever is interfered with an object, which is not the cover to be displaced. In this manner, in the conventional judgment device for performing the open/close judgment of the opening, there is room for improving the judgment accuracy.

Note that such a problem is not limited to the open/close judgment of the opening through which attachment and detachment of an ink cartridge equipped in an ink jet printer is performed, and is a common problem in the case where the open/close judgment of an opening included in a device is performed.

SUMMARY

An advantage of some aspects of the invention is to provide a technique which makes it possible to improve accuracy of an open/close judgment of an opening of a device.

According to an aspect of the invention, there is provided a device including an opening/closing mechanism for opening and closing an opening of the device, a light emitting portion for emitting light, a light receiving portion whose positional relationship with the light emitting portion is changed in accordance with an open/close operation of the opening by the opening/closing mechanism, the light receiving portion being disposed so as to be able to receive the light emitted from the light emitting portion in a state where the opening is closed and so as not to be able to receive the light emitted from the light emitting portion in a state where the opening is opened, a judgment unit for judging whether or not the opening is closed based on a light receiving state of the light receiving portion, a first movable body having a plurality of slits aligned in a predetermined direction, the first movable body being positioned on an optical pathway from the light emitting portion to the light receiving portion in a state where the opening is closed and being capable of moving along the predetermined direction, a second movable body disposed in the device, the second movable body being capable of moving, and a movement transmission mechanism for moving the first movable body along the predetermined direction in accordance with the movement of the second movable body.

With the device, whether or not the opening is closed or not can be judged based on the light receiving state of the light receiving unit. Further, the first movable body includes the plurality of slits aligned in the predetermined direction, and is positioned on the optical pathway from the light emitting unit to the light receiving unit in the state where the opening is opened. Accordingly, the light receiving state of the light receiving portion repeats a light receiving state and a light non receiving state by moving the first movable body in the predetermined direction in accordance with the movement of the second movable body. Consequently, with the device, accuracy of the open/close judgment of the opening of the device can be improved.

It is preferable that the first movable body is a linear scale having a straight shape capable of being reciprocated along the predetermined direction, and the movement transmission mechanism moves the linear scale in accordance with the movement of the second movable body in the device according to an aspect of the invention.

With the device, accuracy of the open/close judgment of the opening of the device can be improved by moving the linear scale in accordance with the movement of the second movable body.

It is preferable that the first movable body is a rotary scale having a circular shape which is capable of being rotated along the predetermined direction, and the movement transmission mechanism rotates the rotary scale in accordance with the movement of the second movable body according to an aspect of the invention.

With the device, accuracy of the open/close judgment of the opening of the device can be improved by rotating the rotary scale in accordance with the movement of the second movable body.

It is preferable that the second movable body is a carriage that is reciprocated in the device according to the aspect of the invention.

With the device, accuracy of the open/close judgment of the opening of the device can be improved by using the carriage that is reciprocated in the device.

Note that the invention can be provided with various aspects. For example, the invention can be provided by a method, a device, a printing apparatus, and the like of open/close judgment of an opening.

The invention will be described with reference to the accompanying drawings, wherein like numbers reference like elements.

DESCRIPTION OF EXEMPLARY EMBODIMENTS

Next, an embodiment of the invention will be described based on first to fourth examples and modifications.

A. First Example

Figure 1:
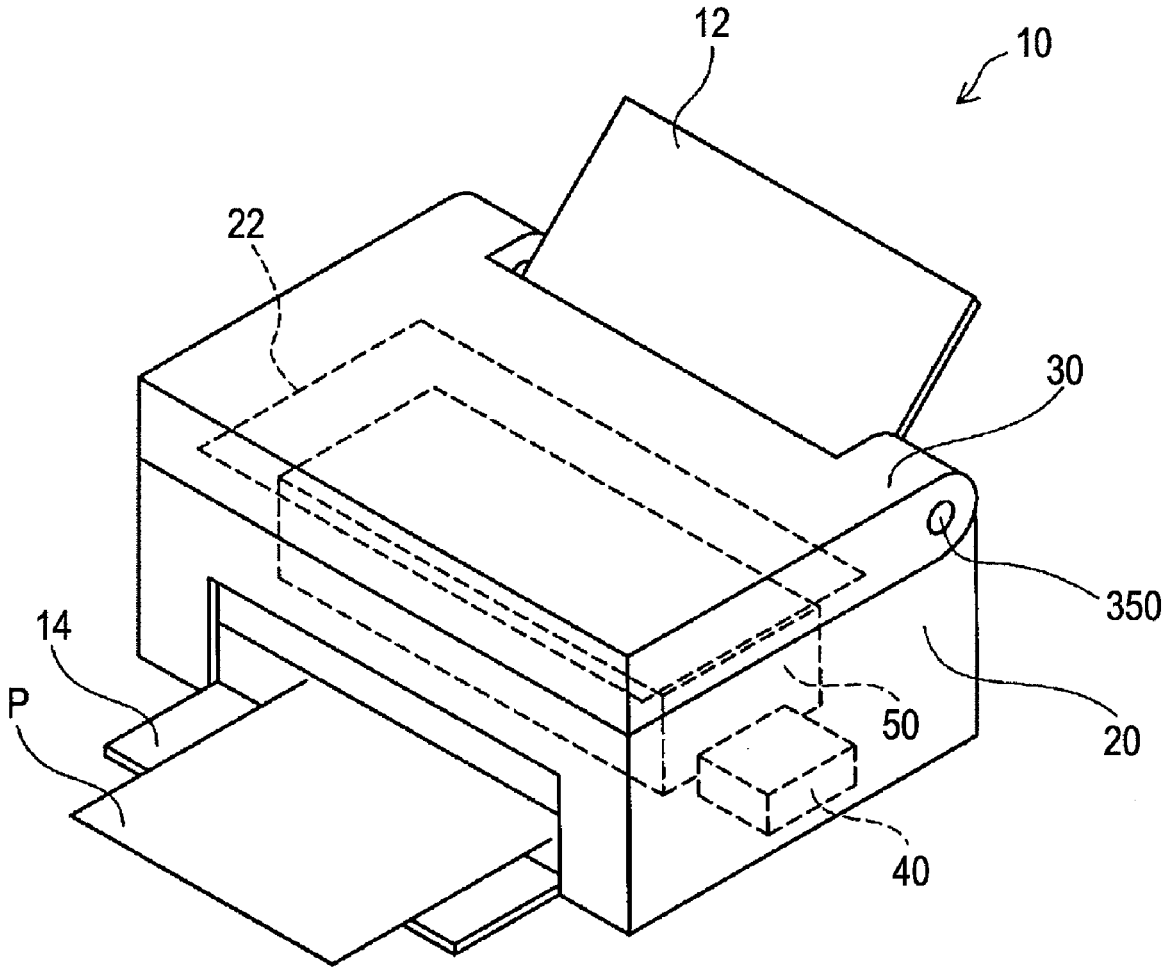
FIG. 1 an illustration diagram schematically showing the structure of a printer according to an embodiment of the invention.

FIG. 1 is an illustration diagram schematically showing the structure of a printer 10 according to an embodiment of the invention. The printer 10 is an ink jet type printer that records a character or a graphic by ejecting liquid ink onto a print paper P, which is a recording medium. Further, the printer 10 is a multi function type printer and includes a scanner function by which an image is optically read.

As shown in FIG. 1, the printer 10 includes a main body housing 20 for accommodating a print mechanism 50. A paper feed tray 12 for introducing the print paper P that is supplied to the print mechanism 50 into the main body housing 20, and a paper discharge tray 14, for discharging the print paper P discharged from the print mechanism 50 outside the main body housing 20, are provided in the main body housing 20. The detailed structure of the print mechanism 50 will be described below.

A controller 40 for controlling each portion of the printer 10 is accommodated in the main body housing 20. In the example, the controller 40 includes an ASIC (Application Integrated Circuits) equipped with hardware such as a CPU (Central Processing Unit), a ROM (Read Only Memory), a RAM (Random Access Memory), and the like. Software for providing each function of the printer 10 is installed in the controller 40.

Figure 2:
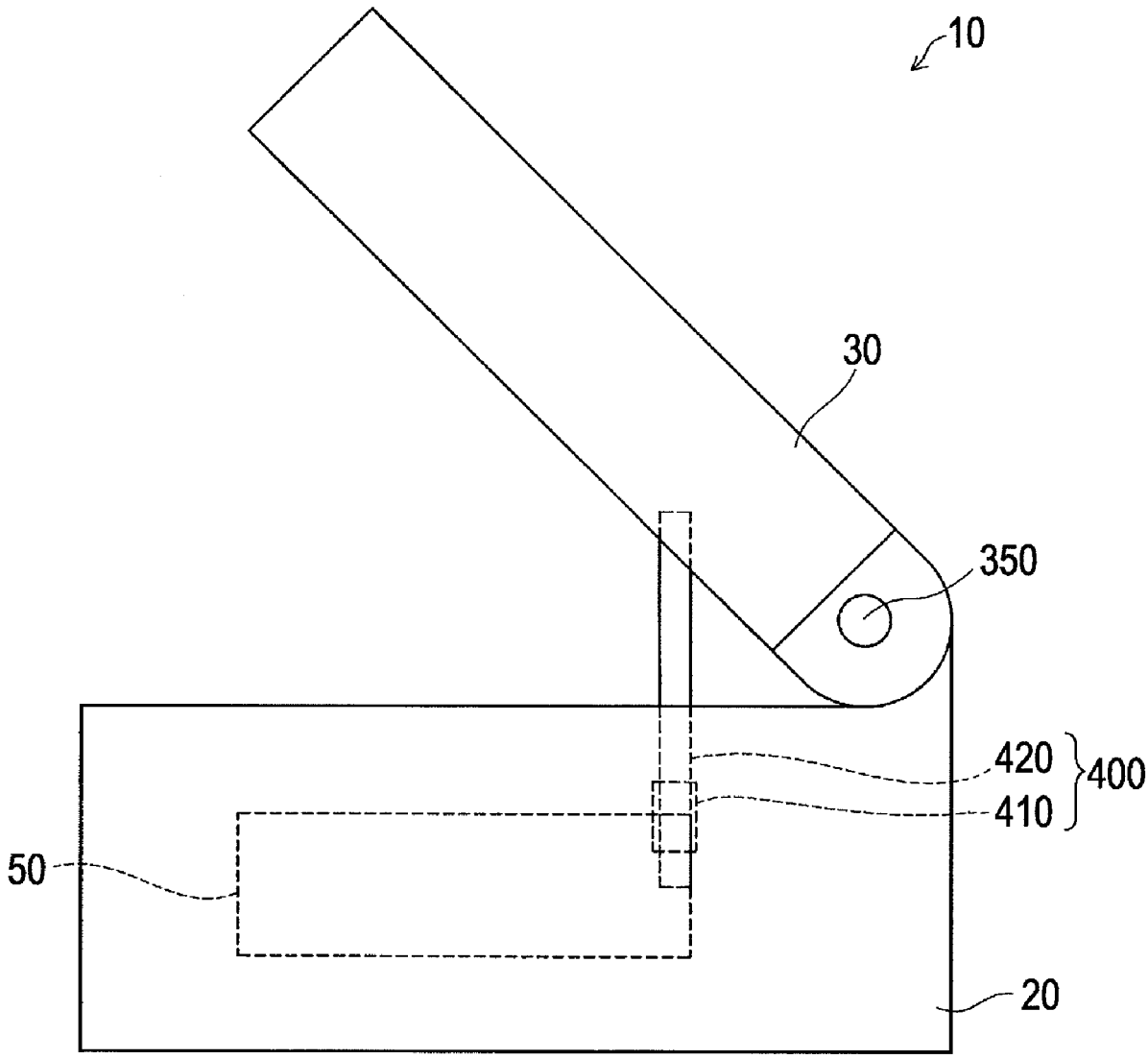
FIG. 2 is an illustration diagram showing a state where an upper housing of the printer is moved in the upper direction.

An upper housing 30 is provided at the upper part of the main body housing 20. A scanner mechanism (not shown) for providing a scanner function is accommodated in the upper housing 30. The upper housing 30 is provided on the main body housing 20 so as to be able to be rotationally moved about a rotation shaft 350. FIG. 2 is an illustration diagram showing a state in which the upper housing 30 of the printer 10 is moved in the upper direction. When the upper housing 30 is rotationally moved in the upper direction about the rotation shaft 350, an opening 22 (FIG. 1), provided in at least a part of the upper surface of the main body housing 20, is opened. In this state, the user can access to the print mechanism 50 via the opening 22. When the upper housing 30 is rotationally moved in the lower direction and covers the upper portion of the main body housing 20 (see FIG. 1), the opening 22 is closed. The upper housing 30 corresponds to the opening/closing mechanism of the invention.

Figure 3B:
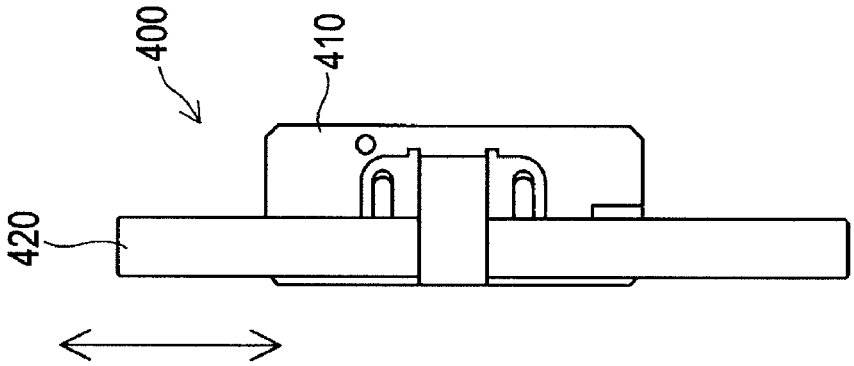
FIGS. 3A and 3B are each an illustration diagram showing the structure of a sensor unit.
Figure 3A:
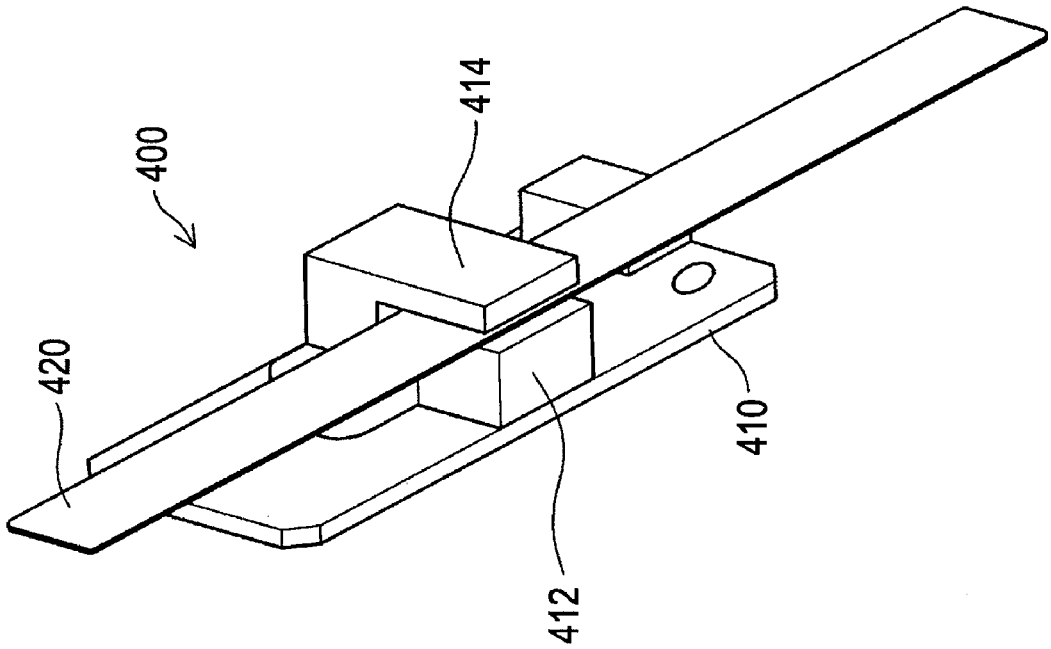

As shown in FIG. 2, the printer 10 includes a sensor unit 400. FIGS. 3A and 3B are each an illustration diagram showing the structure of the sensor unit 400. FIG. 3A is a perspective view of the sensor unit 400, and FIG. 3B is a front view of the sensor unit 400. As shown in FIGS. 2, 3A, and 3B, the sensor unit 400 includes a liner scale 420 and a sensor 410.

The linear scale 420 is joined with the upper housing 30 (see FIG. 2), and is reciprocated along the longitudinal direction in accordance with the rotational movement of the upper housing 30 (that is, open/close operation of the opening 22 of the main body housing 20) (see the arrows of FIG. 3B). Further, the linear scale 420 includes a plurality of openings (e.g. slits) (not shown) arranged at predetermined interval (for example, 180 dpi) along the longitudinal direction.

The sensor 410 is a photo interrupter sensor having a light emitting portion 412 and a right receiving unit 414, that are opposed about the linear scale 420. The light emitting portion 412 emits light from a light emitting element not shown and the right receiving unit 414 receives the light emitted from the light emitting portion 412 by a light receiving element (not shown). The sensor 410 is fixed to the print mechanism 50 (or main body housing 20).

When the linear scale 420 is moved along the longitudinal direction with the rotational movement of the upper housing 30, a light receiving state exists in which the light emitted from the light emitting portion 412 is passed through the slits of the linear scale 420 and received by the light receiving portion 414, and a non-light receiving state exists in which the light emitted from the light emitting portion 412 is shielded by the linear scale 420 and not received by the light receiving portion 414. The light and non-light states are alternately repeated. Simultaneously, the light receiving portion 414 outputs a pulse signal showing a repetition of the light receiving state and the non-light receiving state. In this example, the light receiving portion 414 outputs two pulse signals with phases that are different from each other. The sensor 410 detects the moving direction and the amount of movement on the linear scale 420, based on the phase difference and pulse numbers between and of the two pulse signals. Note, the amount of movement on the linear scale 420 can be expressed also by the amount of motion.

Figure 4:
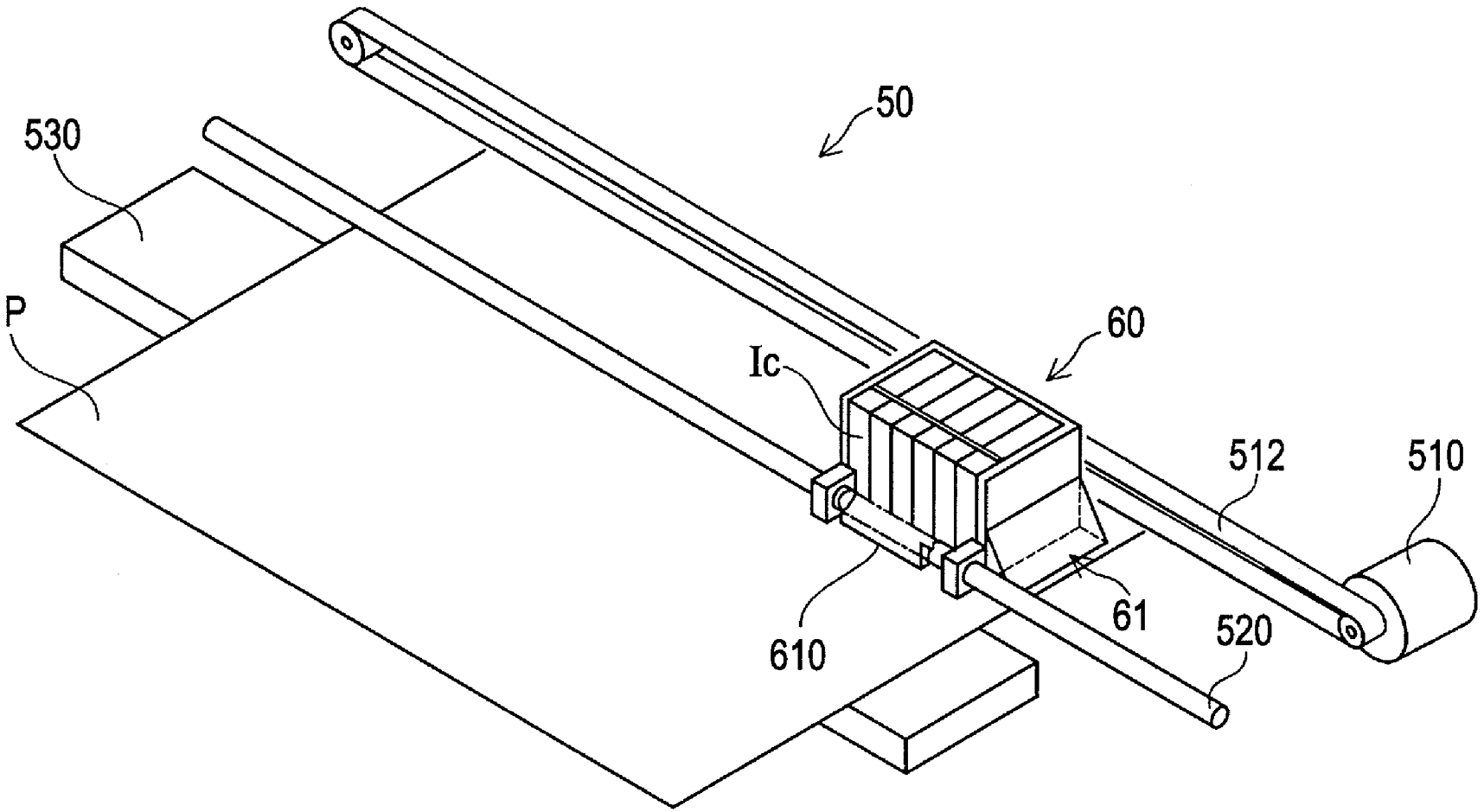
FIG. 4 is an illustration diagram showing the structure of a print mechanism.

FIG. 4 is an illustration diagram showing the structure of the print mechanism 50. The print mechanism 50 includes a platen 530 having a rectangular shape disposed in a print area in which an ink drop is ejected onto a print paper P. A paper P is fed on the platen 530 by a paper feed mechanism (not shown). Further, the print mechanism 50 has a carriage 60 having a recording head 610 in which an ink cartridge Ic is mounted. The carriage 60 is supported by a guide rod 520 so as to be able to be moved along the longitudinal direction of the platen 530, and is driven by a carriage motor 510 via a timing belt 512. Herewith, the carriage 60 is reciprocated along the longitudinal direction on the platen 530 (main scanning). The recording head 610 receives the ink supplied from the ink cartridge Ic mounted in the carriage 60 and ejects the ink onto the print paper P. The carriage 60 corresponds to the second movable body of the invention.

As shown in FIG. 4, the carriage 60 includes a tapered portion 61 having an approximately triangular prism shape at one end along the moving direction.

Figure 5:
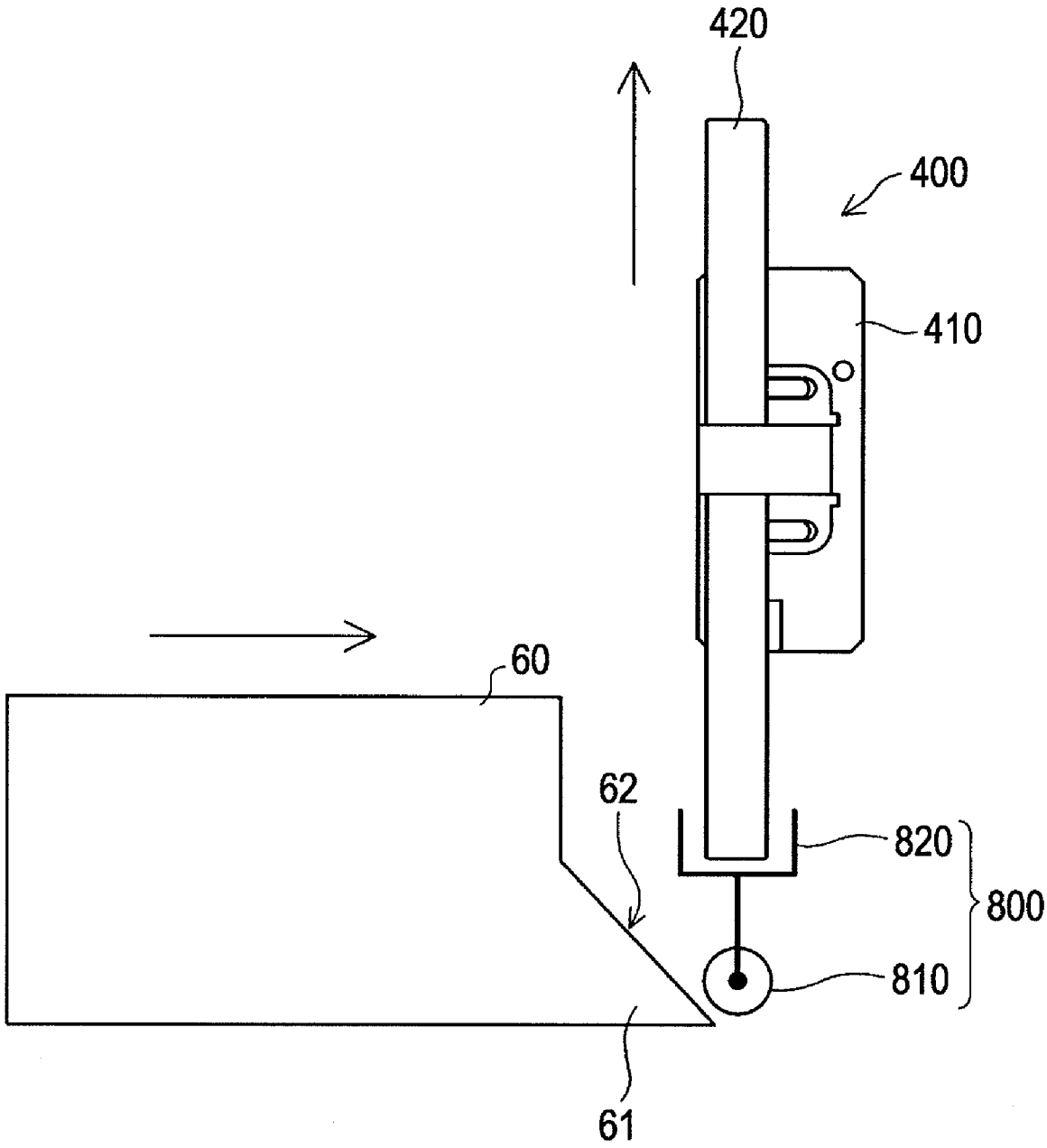
FIG. 5 is an illustration diagram showing a relationship between a carriage and the sensor unit.

FIG. 5 is an illustration diagram showing a relationship between the carriage 60 and the sensor unit 400. FIG. 5 is a diagram of the carriage 60 and the sensor unit 400 viewed from a side direction. As shown in FIG. 5, the printer 10 includes a transmission portion 800 interposed between the carriage 60 and the sensor unit 400. The transmission portion 800 includes a wheel 810 having a circle shape in cross section, and a support portion 820 that is connected with the wheel 810 and is capable of supporting the lower end of the linear scale 420. The transmission portion 800 is disposed at a position where the wheel 810 is interfered with a tapered face 62 of the tapered portion 61 of the carriage 60, when the carriage 60 is moved. The transmission portion 800 is pushed up in the upper direction as a whole by rising of the wheel 810 along the tapered face 62 with the access of the carriage 60.

The transmission portion 800 is disposed at such a position that the linear scale 420 is pushed up by the support portion 820. This is in accordance with the movement of the transmission portion 800 in the upper direction with the movement of the carriage 60 during a closed state, in which the upper portion of the main body housing 20 is covered by the upper housing 30 and the opening 22 is closed (see FIG. 1). In addition, the transmission portion 800 is disposed at such a position that the support portion 820 does not interfere with the linear scale 420. The linear scale 420 is not pushed up in the upper direction when the transmission portion 800 is moved in the upper direction with the movement of the carriage 60 during an opened state, in which the upper housing 30 is moved in the upper direction and the opening 22 is opened (that is, the state where the linear scale 420 is moved in the upper direction) (see FIG. 2). Accordingly, in the printer 10, the linear scale 420 can be moved in the upper direction in accordance with the movement of the carriage 60 in the closed state. However, in the opened state, the linear scale 420 can not be moved in accordance with the movement of the carriage 60.

In the printer 10 of the example, the controller 40 performs an open/close judgment of the opening 22 of the main body housing 20 based on a result detected by the sensor unit 400. That is, the controller 40 functions as the judgment unit. Specifically, assuming that the state in which the upper portion of the main body housing 20 is covered with the upper housing body 30 to close the opening 22 is a reference state, the controller 40 judges that the opening 22 is closed or opened by detecting the position of the upper housing 30 based on the moving direction and the amount of movement of the linear scale 420 from the reference state that are detected by the sensor 410. Accordingly, in the printer 10 of the example, the open/close judgment of the opening 22 can be performed with a high accuracy regardless of variations of size, and position of each portion of the printer 10.

Note, the closed state may be when the opening 22 is completely closed by an opening/closing mechanism such as the upper housing 30. In this case, the controller 40 judges that the opening 20 is closed in the case where the moving amount of the detected linear scale 420 from the reference state is zero, and judges that the opening 22 is opened in the case where the detected moving amount is larger than zero. Further, the closed state may not require the opening 22 to be completely closed, but can be when the opening 22 is opened by a predetermined fractional amount. In this case, the controller 40 judges that the opening 22 is closed in the case where the moving amount of the detected linear scale 420 from the reference state is not more than a predetermined threshold vale, and judges that the opening 22 is opened in the case where the detected moving amount is larger than the predetermined threshold value.

Further, the controller 40 can perform an open/close judgment of the opening 22 based on the presence or absence of the movement of the linear scale 420, in accordance with the movement of the carriage 60. That is, the controller 40 moves the carriage 60 at a position at which the carriage 60 can be interfered with the transmission portion 800. The controller 40 judges that the opening 22 is closed in the case where the movement of the linear scale 420, in accordance with the movement of the carriage 60, is detected by the sensor 410, and judges that the opening 22 is opened in the case where the movement of the linear scale 420, in accordance with the movement of the carriage 60, is not detected. Accordingly, for example, the controller 40 further performs the open/close judgment of the opening 22 based on the presence or absence of the movement of the linear scale 420 in accordance with the movement of the carriage 60. The controller 40 also judges that the opening 22 is closed by the open/close judgment of the opening 22, based on the moving direction and the moving amount of the linear scale 420 from the reference state. Thus, when it is judged that the opening 22 is closed by the both open/close judgments, the controller 40 can finally judge that the opening 22 is affirmatively closed. Herewith, misjudgment can be prevented by performing the judgment based on the presence or absence of movement of the linear scale 42 in accordance with the movement of the carriage 60. This occurs even when it is misjudged that the opening 22 is closed, and regardless of the state where the opening 22 is opened in reality by some reason in the judgment based on the moving direction and the amount of movement of the linear scale 420 from the reference state. Accordingly, in the printer 10 of the example, the accuracy of the open/close judgment of the opening 22 of the main body housing 20 can be improved.

B. Second Example

Figure 6:
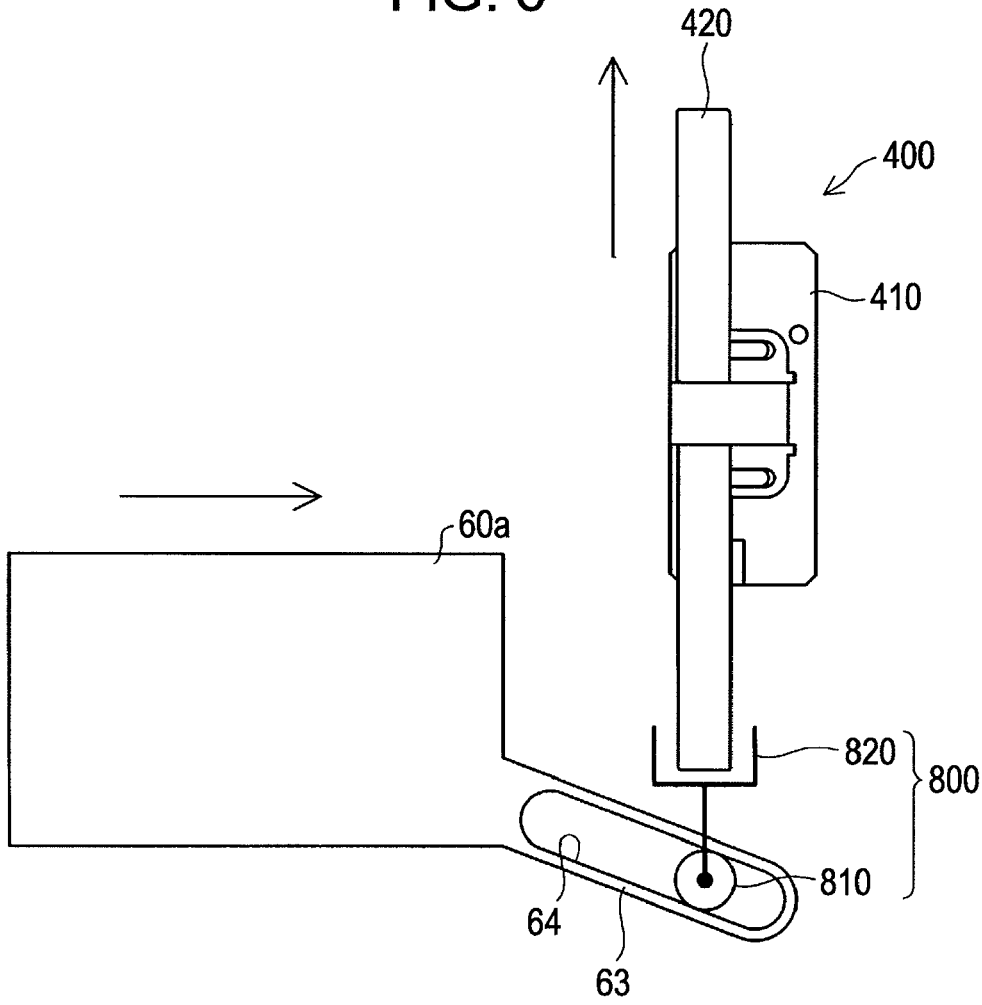
FIG. 6 is an illustration diagram showing a relationship between a carriage and the sensor unit according to an embodiment of the invention.

FIG. 6 is an illustration diagram showing a relationship between a carriage 60*a* and the sensor unit 400, according to an embodiment of the invention. FIG. 6 is a diagram of the carriage 60*a* and the sensor unit 400 viewed from a side direction. Also in the second example, similarly to the first example shown in FIG. 5, the transmission portion 800 is interposed between the carriage 60*a* and the sensor unit 400. However, in the second example, the relationship between the carriage 60*a* and the transmission portion 800 is different from that in the first example shown in FIG. 5. The other structure of the printer 10 of the second example is the same as that in the first example.

The carriage 60*a* includes a coupling portion 63 having a bar shape extending in an oblique lower direction from the carriage 60*a*. The coupling portion 63 includes a hole 64 having an elongated ellipse shape, and the wheel 810 of the transmission portion 800 is engaged with the hole 64 so as to be slidably moved.

In use, the carriage 60*a* is moved in the direction of the transmission portion 800, the position of the wheel 810 in the hole 64 of the coupling portion 63 is moved in the upper direction, and the transmission portion 800 is pushed up in the upper direction as a whole. Accordingly, the open/close judgment of the opening 22 based on the presence or absence of the moving of the linear scale 420 in accordance with the movement of the carriage 60*a* can be performed, and accuracy of the open/close judgment of the opening 22 of the main body housing 20 can be improved.

C: Third Example

Figure 7:
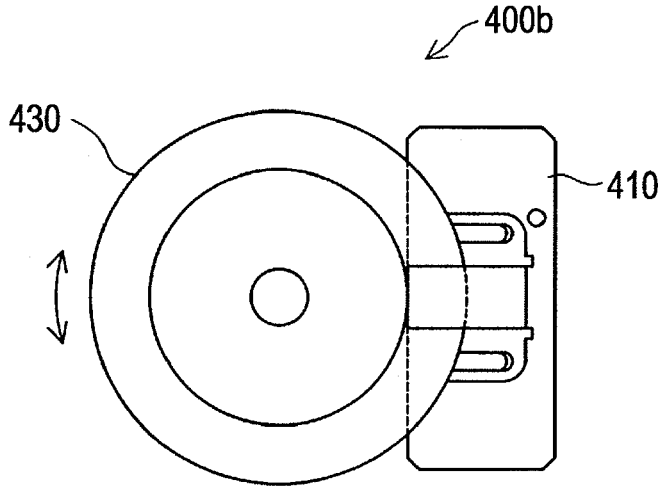
FIG. 7 is an illustration diagram schematically showing a sensor unit according to an embodiment of the invention.

FIG. 7 is an illustration diagram schematically showing the structure of a sensor unit 400*b* according to an embodiment of the invention. In the third example, the point that the sensor unit 400*b* includes a rotary scale (rotation scale) 430 instead of the linear scale 420 of sensor unit 400 (see FIGS. 3A and 3B) of the first example. The other structure of the printer 10 of the third example is the same as that in the first example.

The rotary scale 430 is combined with the upper housing 30 via, for example, a link so as to rotate in accordance with rotary movement of the upper housing 30 (that is, open/close operation of the opening 22 of the main body housing 20) (see the arrows of FIG. 7). Further the rotary scale 430 has a plurality of slits (not shown in FIG. 7) aligned at predetermined interval along the circumference direction. Similarly to the first example, the sensor 410 detects the rotation direction and the amount of rotation of the rotary scale 430 based on the variation of the phase, and the pulse number of two pulse signals having a different phase to each other. Note that the amount of rotation of the rotary scale 430 may be also expressed by movement amount.

Figure 8A:
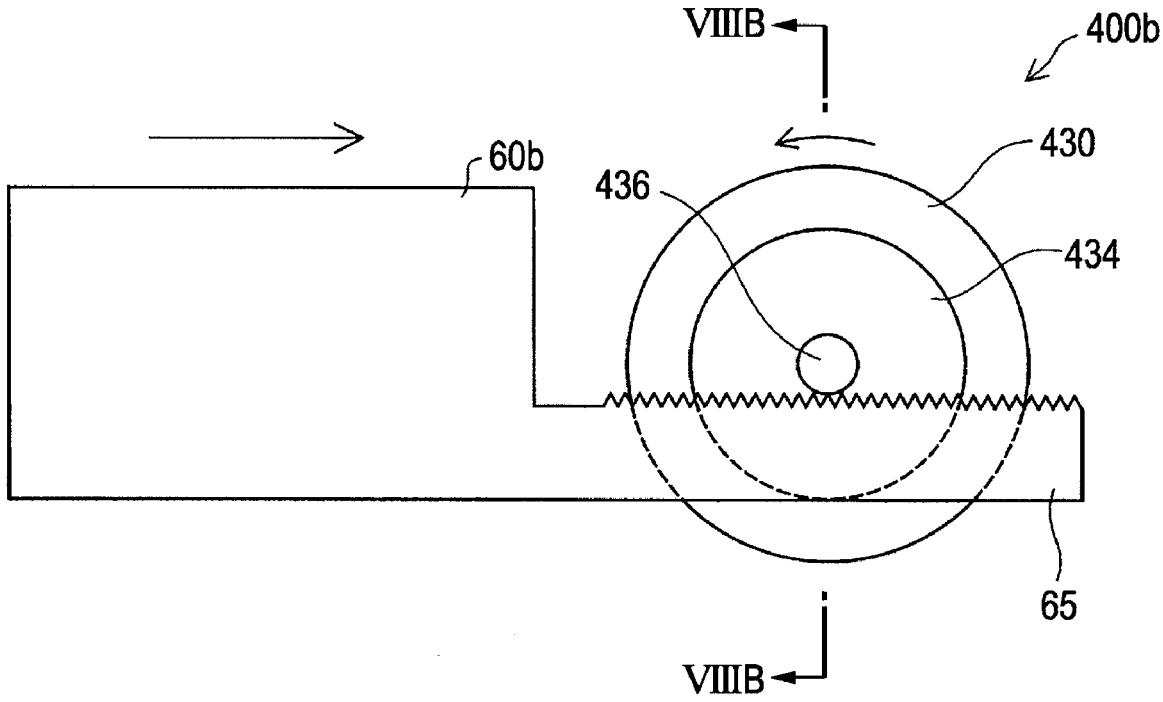
FIGS. 8A and 8B are each an illustration diagram showing a relation between a carriage and the sensor unit of FIG. 7.
Figure 8B:
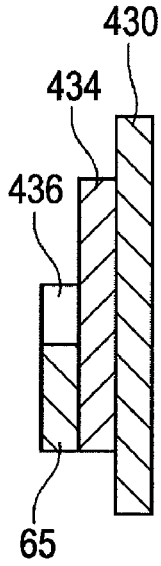

FIGS. 8A and 8*b* are each an illustration diagram showing a relationship between a carriage 60*b* and the sensor unit 400*b*. FIG. 8A is a diagram showing the carriage 60*b* and the sensor unit 400*b* viewed from a side direction, and FIG. 8B is a cross sectional view taken along the line VIIIB-VIIIB of FIG. 8A. The carriage 80*b* includes an arm 65 horizontally extending toward the direction of the sensor unit 400*b*. As shown in FIG. 8A, a plurality of teeth are formed on the upper surface of the arm 65. Further, the rotary scale 430 is connected to a gear 436 via an intermediate member 434. The teeth of the gear 436 are engaged with the teeth of the arm 65, and the gear 436 rotates with the horizontal movement (of the arm 65) of the carriage 60*b*. Consequently, the rotary scale 630 also rotates with the horizontal movement (of the arm 65) of the carriage 60*b*.

The positional relationship between the arm 65 and the gear 436 will be described below. The teeth of the gear 436 are engaged with the teeth of the arm 65 in the closed state, in which the upper part of the main body housing 20 is covered by the upper housing 30 to close the opening 22 (see FIG. 1). The teeth of the gear 436 are not engaged with the teeth of the arm 65 in the opened state, in which the upper housing 30 is moved in the upper direction to open the opening 22 (see FIG. 2) (that is, in the state where the rotary scale 430 and the gear 436 are moved in the upper direction). Consequently, the rotary scale 430 can be rotated in accordance with the movement of the carriage 60*b* in the closed state. However, the rotary scale 430 can not be rotated in accordance with the movement of the carriage 60*b* in the opened state.

Also in the third example, since the rotary scale 430 is rotated in accordance with the rotary movement of the upper housing 30 (that is, open/close operation of the opening 22 of the main body housing 20). The open/close judgment of the opening 22 of the main body housing 20 can be performed based on the result of the rotation direction and rotation amount of the rotary scale 430 detected by the sensor unit 400*b*. The open/close judgment of the opening 22 can be performed with a high accuracy regardless of the variations of the size and the position of each portion of the printer 10. Further, also in the third example, since the open/close judgment of the opening 22 can be performed based on the presence or absence of the rotation of the rotary scale 430 in accordance with the movement of the carriage 60*b*, the accuracy of the open/close judgment of the opening 22 of the main body housing 20 can be improved.

D. Fourth Example

Figure 9:
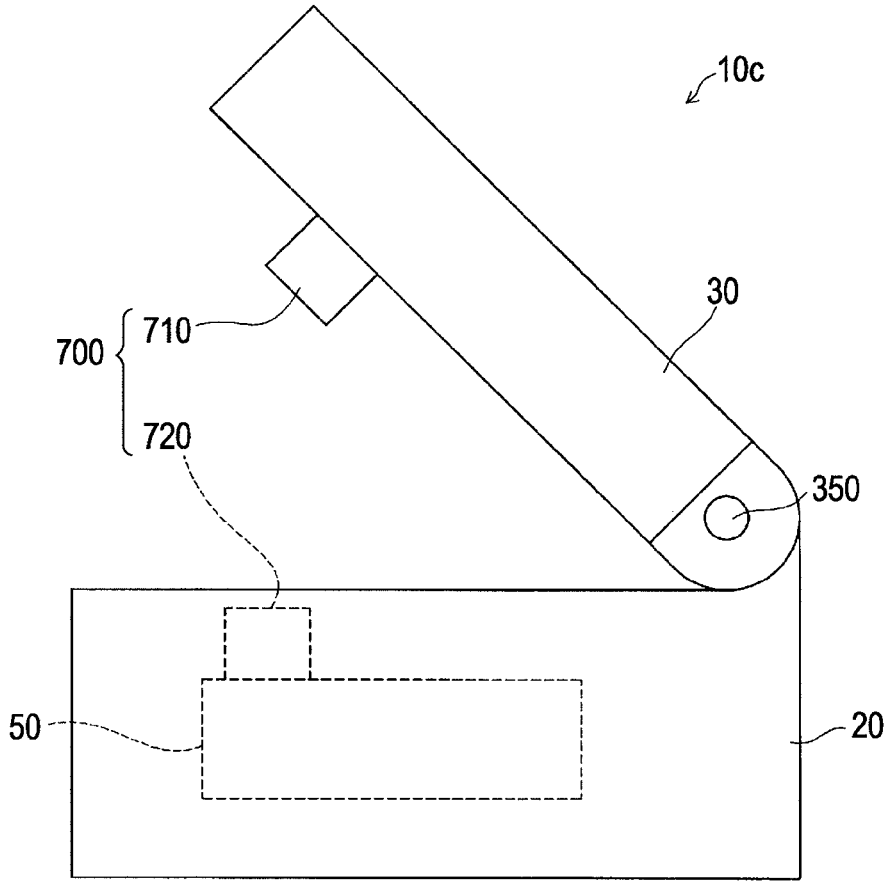
FIG. 9 is an illustration diagram schematically showing the structure of a printer according to an embodiment of the invention.

FIG. 9 is an illustration diagram schematically showing the structure of a printer 10*c* according to an embodiment of the invention. In the fourth example, the structure of a sensor unit 700 is different from the sensor unit 400 of the first example shown in FIG. 2. The other structure of the printer 10*c* of the fourth example is the same as that of the first example.

The sensor unit 700 includes a light emitting portion 710 and a light receiving portion 720, and a linear scale 730 described below. As shown in FIG. 9, the light emitting portion 710 is joined with the upper housing 30, and is moved up and down in accordance with the rotational movement of the upper housing 30 (that is, open/close operation of the opening 22 of the main body housing 20). Further, the light receiving portion 720 is fixed with the print mechanism 50 (or main body housing 20). That is, the relative positional relationship between the light emitting portion 710 and the light receiving portion 720 is changed in accordance with the rotational movement of the upper housing 30. In the closed state, in which the upper portion of the housing main body 20 is covered by the upper housing 30 to close the opening 22, the optical axis of the light emitting portion 710 is aligned with the optical axis of the light receiving portion 720. Thus, the light receiving portion 720 is placed in a state in which the light emitted from the light emitting portion 710 can be received. On the other hand, in the opened state, in which the upper housing 30 is rotationally moved in the upper direction and the opening 22 is opened, the optical axis of the light emitting portion 710 and the optical axis of the light receiving portion 720 are not aligned. Thus, the light receiving portion 720 is placed in a state in which the light emitted from the light emitting portion 710 can not be received.

Figure 10:
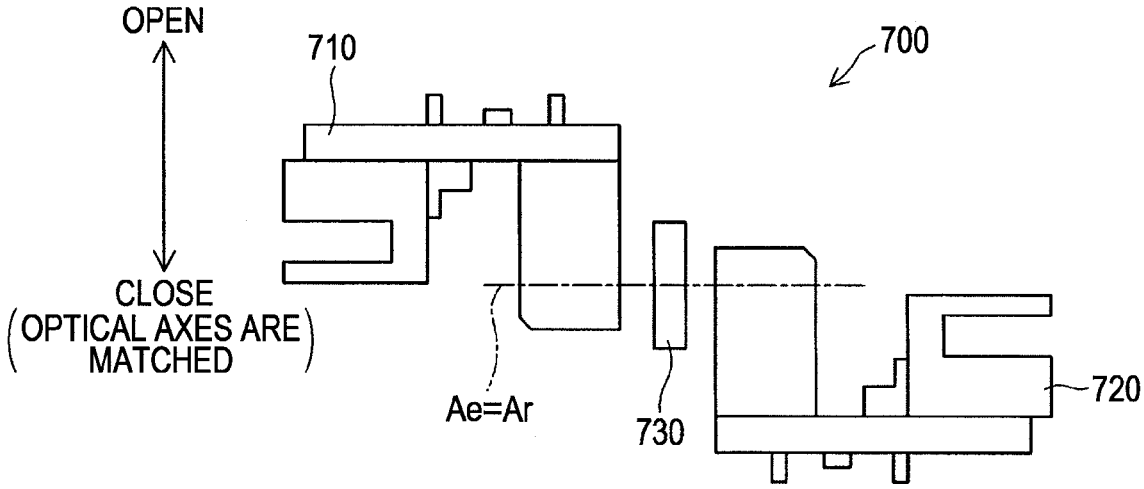
FIG. 10 is an illustration diagram showing the structure of a sensor unit of FIG. 9.

FIG. 10 is an illustration diagram showing the structure of the sensor unit 700. FIG. 10 is a diagram of the sensor unit 700 viewed from a side direction in the state where the optical axis Ae of the light emitting portion 710 is aligned with the optical axis Ar of the light receiving portion 720 (that is, the closed state). The linear scale 730 of the sensor unit 700 is disposed at such a position so as to interfere with the optical axis in the state where the optical axis Ae of the light emitting portion 710 and the optical axis Ar of the light receiving portion 720 are aligned. That is, the linear scale 730 is positioned on an optical pathway from the light emitting portion 710 to the light receiving portion 720 in the opening closed state in which the opening 22 is closed. Further, the linear scale 730 has a plurality of slits not shown aligned at predetermined intervals along the longitudinal direction (horizontal direction). The linear scale 730 corresponds to the first movable body of the invention.

Figure 11:
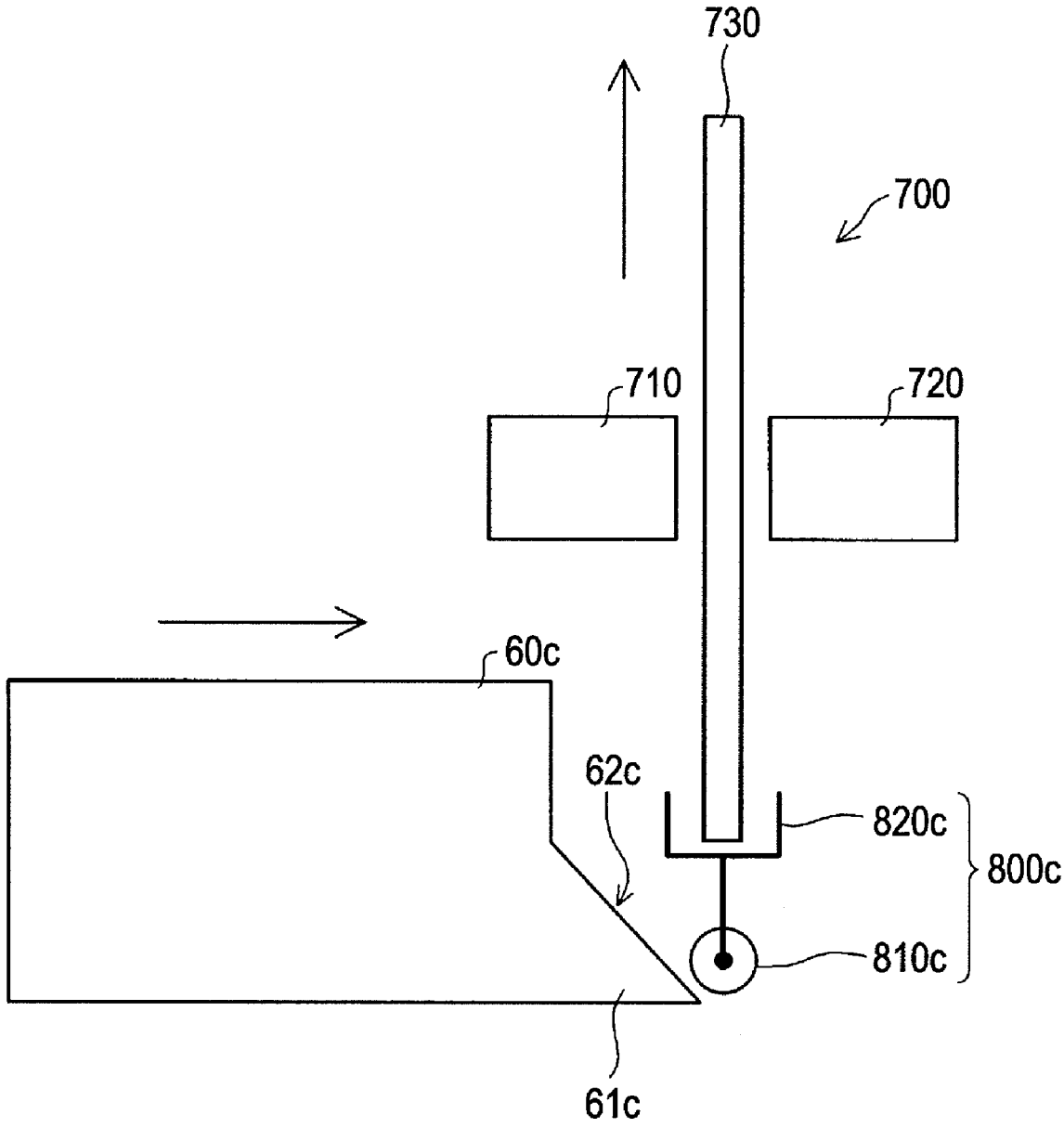
FIG. 11 is an illustration diagram showing a relationship between a carriage and the sensor unit of FIG. 9.

FIG. 11 is an illustration diagram showing a relationship between a carriage 60*c* and the sensor unit 700. FIG. 11 is a diagram of the carriage 60*c* and the sensor unit 700 viewed from the upper direction. Similarly to the first example, the carriage 60*c* includes a tapered portion 61*c*. However, the tapered portion 61*c* of the fourth example is different from the tapered portion 61 of the first example at the point where a tapered face 62*c* exists at a side instead of the upper direction. Further, the printer 10*c* has a transmission portion 800*c* interposed between the carriage 60*c* and the sensor unit 700. Similarly to the first example, the transmission portion 800*c* includes a wheel 810*c* and a support portion 820*c*. The transmission portion 800*c* is disposed at such a position that the wheel 810*c* is interfered with the tapered face 62*c* of the tapered portion 61*c* of the carriage 60*c*, and the transmission portion 800*c* is horizontally moved as a whole when the wheel 810*c* is horizontally moved along the tapered face 62*c* with the access of the carriage 60*c*. The transmission portion 800*c* is disposed at such a position that the linear scale 730 is horizontally moved by the support portion 820*c* in accordance with the horizontal movement of the transmission portion 800*c* with the movement of the carriage 60*c*. At this time, the moving direction of the linear scale 730 is a direction in which the plurality of slits are aligned (see the arrow of FIG. 11). Note that the carriage 60*c* corresponds to the second movable body of the invention and the transmission portion 800*c* corresponds to the movement transmission mechanism of the invention.

In the state where the optical axis Ae of the light emitting portion 710 and the optical axis Ar of the light receiving portion 720 are aligned as shown in FIG. 10 (that is, the closed state), the sensor unit 700 can detect the movement of the linear scale 730. That is, when the linear scale 730 is stationary, the light receiving portion 720 outputs a signal indicating a light receiving state. On the other hand, when the linear scale 730 is moved, the light receiving portion 720 outputs a pulse signal indicating that a light receiving state and a non-light receiving state are repeated. Accordingly, when the light receiving portion 720 outputs a pulse signal, the movement of the linear scale 730 is detected. On the other hand, in the state where the optical axis Ae of the light emitting portion 710 and the optical axis Ar of the light receiving portion 720 are not aligned (that is, opening opened state), the light receiving portion 720 outputs a signal for showing the non-light receiving state, regardless of the presence or absence of the movement of the linear scale 730, so that the sensor unit 700 can not detect the movement of the linear scale 730.

In the printer 10*c* of the fourth example, the controller 40 performs the open/close judgment of the opening 22 of the main body housing 20 by detecting matching of the optical axes of the light emitting portion 710 and the light receiving portion 720. That is, the controller 40 functions as the judgment unit. Specifically, the controller 40 judges that the opening 22 is closed when it is detected that the signal for the light receiving state is outputted from the light receiving portion 720, and judges that the opening 22 is opened when it is detected that the signal for the non-light receiving state is outputted from the light receiving portion 720.

Further, the controller 40 can perform the open/close judgment of the opening 22 based on the presence or absence of the detection of the movement of the linear scale 730 in accordance with the movement of the carriage 60*c*. That is, the controller 40 moves the linear scale 730 by moving the carriage 60*c* to such a position that the carriage 60*c* interferes with the transmission portion 800*c*, and judges whether or not the movement of the linear scale 730 is detected by the sensor unit 700. When the movement of the linear scale 730 is detected, the controller 40 judges that the opening 22 is closed, and when the movement of the linear scale is not detected, the controller judges 40 that the opening 22 is opened. In the fourth example, an error judgment can be prevented by performing the open/close judgment based on presence or absence of the detection of the movement of the linear scale 730 in accordance with the movement of the carriage 60*c*, even when an error judgment that the opening 22 is closed is made, although the opening 22 is in the opened sate in reality due to some reason in the open/close judgment of the opening 22 that is performed by detecting the alignment of the optical axes of the light emitting portion 710 and the light receiving portion 720. Accordingly, the accuracy of the open/close judgment of the opening 22 of the main body housing 20 can be improved in the printer 10*c* of the fourth example.

E. Modifications

Note that the invention is not limited to the aforementioned examples, and can be executed by various aspects without departing from the scope thereof, and for example, can be executed by the following modifications.

E1. Modification 1

In the aforementioned examples, the printer 10 is a multi function type printer. However, the printer 10 may be a single function type printer having no scanner function. In this case, the opening 22 is opened and closed by a cover. The printer 10 is an on-carriage type in which an ink carriage Ic is mounted in the carriage 60. However, the printer 10 may be an off carriage type in which an ink cartridge Ic is not mounted in the carriage 60. Further the printer may not be a printer of an ink jet type, and may be a printer of another type (for example, laser printer).

Further, the open/close judgment of the opening 22 of the main body housing 20 is described in each example. However, the invention can be also applied to an open/close judgment of another opening (for example, an opening for discharging a paper that is opened and closed by the discharge tray 14 (see FIG. 1)). Further, in the aforementioned each example, the open/close judgment of the opening equipped in the printer 10 is described. However, the invention can be applied not only to the printer 10, but also to open/close judgment of an opening equipped in a general device. Further, since the position of the upper housing 30 can be detected with high accuracy in the aforementioned each example, the invention can be applied not only to the open/close judgment of the opening, but also to detection of the amount of opening of the opening/closing mechanism (i.e., level of the opening).

E2. Modification 2

In the aforementioned each example, the sensor is employed in which the light emitting portion (light emitting portion 412 or the light emitting portion 710) and the light receiving portion (light receiving portion 414 or the light receiving portion 720) are oppositely disposed as a sensor. However, a reflection type sensor can be also employed in which a light emitting portion and a light receiving portion are arranged in parallel.

E3. Modification 3

In the aforementioned each example, the linear scale 420, the rotary scale 430, the linear scale 730, or the like are employed as the first movable body. However, it is not necessary that the first movable body is a scale. Further, in the aforementioned each example, the sensor unit 400 or the sensor unit 700 is employed as a movement detection unit for detecting a moving amount of the first movable body. However, it is not necessary that the movement detection unit is a sensor, as long as it can detect the movement amount of the first movable body. For example, in the first example, the sensor 410 may be connected to the upper housing 30 and moved up and down in accordance with the rotary movement of the upper housing 30, and the linear scale 420 may be fixed to the print mechanism 50 (or main body housing 20). In this case, the sensor 410 corresponds to the first movable body.

Further, in the aforementioned each example, the carriage 60 (60*a*, 60*b*, 60*c*) is employed as the second movable body. However, the second movable body may be another movable element. For example, in the case where the printer includes a processing gap adjustment mechanism (APG: Auto Platen Gap mechanism) (JP-A-2008-80649) for adjusting the gap between the surface of the platen 530 and the recording head 610 in order to perform a print processing on print papers P having different thickness, or a direct printing on a surface of a CD-R, the processing gap adjustment mechanism can be used as the second movable body. Further, when the printer includes an EJ frame (ejection frame), the EJ frame can be used as the second movable body.

E4. Modification 4

In the fourth example, the structure is employed in which the linear scale 730 is horizontally moved in accordance with the movement of the carriage 60*c* regardless of the closed state or the opened state. However, a structure may be employed in which the linear scale 730 is moved in accordance with the movement (i.e., open/close operation of the opening 22) of the upper housing 30 and the linear scale 730 is horizontally moved in accordance with the movement of the carriage 60*c* in the opening opened state. Further, the moving direction of the linear scale 730 in accordance with the movement of the carriage 60*c* is not limited to the horizontal direction, and may be the vertical direction or an oblique direction.

Further in the fourth example, the light emitting portion 710 is connected with the upper housing 30, and the light receiving portion 720 is fixed to the print mechanism 50 (or main body housing 20). However, the light receiving portion 720 may be connected with the upper housing 30 and the light emitting portion 710 may be fixed to the print mechanism 50 (or main body housing 20).

Further, in the fourth example, the linear scale 730 is employed as the first movable body. However, it is also possible that a rotary scale that has a plurality of slits along the circumferential direction, and rotates in accordance with the movement of the carriage 60*c*, is used instead of the linear scale 730.

E5. Modification 5

In the aforementioned examples, a structure is employed in which the tapered portion 61, the coupling portion 63, and the arm 65 are united with the carriage 60. However, a structure can be also employed in which the tapered portion 61, the coupling portion 63, and the arm 65 are independent from the carriage 60. Also in this case, a structure is employed in which the independent tapered portion 61, the coupling portion 63, and the arm 65 are moved in accordance with the movement of the carriage 60.

Further, as in the aforementioned examples, in the case of employing the structure in which the tapered portion 61, the coupling portion 63, and the arm 65 are united with the carriage 60, the carriage 60 can be designed so as not to protrude from the printer 10.

E6. Modification 6

In the aforementioned examples, a part of the structure provided by a hardware may be substituted by a software, and on the contrary, a part of the structure provided by a software may be substituted by a hardware.

Further, in the case where a part or all of the functions of the invention are provided by a software, the software (computer program) may be stored in a recording medium which can be read by a computer. In the invention, "a recording medium which can be read by a computer" includes not only a portable type recording medium such as a flexible disc, CD-ROM, and the like, but also an internal recording device in a computer such as various types of RAM, ROM, and the like, and an external recording device such as a hard disc that is fixed to a computer.

What is claimed is:

1. A printer comprising:

a printer housing;

an opening/closing mechanism for opening and closing an opening of the printer housing;

a light emitting portion disposed within the printer housing;

a light receiving portion disposed within the printer housing, and having a positional relationship with the light emitting portion which is changed in accordance with opening and closing the opening;

a first movable body having a plurality of openings, the first movable body being positioned on an optical pathway between the light emitting portion and the light receiving portion in a state where the opening is open or closed;

a second movable body disposed in the printer housing;

a movement transmission mechanism for moving the first movable body in accordance with the movement of the second movable body; and a controller configured to determine whether the opening is open or closed based on a light receiving state of the light receiving portion.

2. The printer according to claim 1, wherein the light receiving portion is disposed so as to be able to receive light emitted from the light emitting portion in a state where the opening is closed and so as not to be able to receive the light emitted from the light emitting portion in a state where the opening is opened.

3. The printer according to claim 1, wherein the first movable body comprises a linear scale having a straight shape capable of being reciprocated, and the movement transmission mechanism moves the linear scale in accordance with the movement of the second movable body.

4. The printer according to claim 1, wherein the first movable body comprises a rotary scale having a circular shape capable of being rotated, and the movement transmission mechanism rotates the rotary scale in accordance with the movement of the second movable body.

5. The printer according to claim 1, wherein the second movable body comprises a carriage that is reciprocated in the printer housing.

6. The printer of claim 5, wherein the carriage comprises an angled portion which interfaces with the movement transmission mechanism.

7. The printer of claim 6, wherein the angled portion comprises an opening which the movement transmission mechanism is slidably coupled to.

8. The printer according to claim 1, wherein the printer housing comprises a main body housing and an upper housing rotationally attached to the main body housing.

9. The printer according to claim 8, wherein the opening of the printer housing is between the main body housing and the upper housing.

10. The printer according to claim 9, wherein one of the light emitting portion and light receiving portion is attached to the main body portion and the other is attached to the upper housing.

11. The printer according to claim 1, wherein when light receiving state comprises light being emitted by the light emitting portion and passing through the openings of the first movable body and being received by the light receiving portion.

12. The printer of claim 11, wherein the light receiving portion outputs two pulse signals to the controller regarding the repetition of light being received by the light receiving portion and a repetition of light not being received by the light receiving portion.

13. The printer of claim 1, wherein the movement transmission mechanism moves the first moveable body only when the opening is closed, and cannot move the first moveable body when the opening is opened.

14. The printer of claim 1, wherein the controller is configured to determine whether the opening is open or closed based on movement of the first moveable body.

15. The printer of claim 14, wherein the controller determines that the opening is closed when the amount of movement of the first moveable body as compared to a reference state is zero.

16. The printer of claim 14, wherein the controller determines that the opening is closed when the amount of movement of the first moveable body as compared to a reference state is more than a predetermined threshold value.

17. The printer of claim 14, wherein the controller determines whether or not the opening is closed additionally based on the movement of the second moveable body.

18. The printer of claim 17, wherein the controller is configured to move the second moveably body to interfere with the movement transmission mechanism.

19. The printer of claim 18, wherein the opening is determined to be closed when the movement transmission mechanism is moved and moves the first moveable body, and determined to be opened when the transmission mechanism is moved and does not move the first moveable body.

* * * * *